United States Patent [19]

Nyqvist et al.

[11] Patent Number: 4,983,235

[45] Date of Patent: Jan. 8, 1991

[54] METHOD FOR THE PRODUCTION OF FINE-GRAINED EXPLOSIVE SUBSTANCES

[75] Inventors: Jan-Olof Nyqvist; Anders Hafstrand, both of Karlskoga, Sweden

[73] Assignee: Nobel Kemi AB, Sweden

[21] Appl. No.: 344,576

[22] Filed: Apr. 28, 1989

[30] Foreign Application Priority Data

Apr. 29, 1988 [SE] Sweden ..... 8801610

[51] Int. Cl.[5] ..... D03D 23/00

[52] U.S. Cl. ..... 149/109.6; 264/3.4

[58] Field of Search ..... 149/109.6; 264/3.4

[56] References Cited

U.S. PATENT DOCUMENTS 4,065,529 12/1977 Lavertu et al. ..... 264/3.4

4,900,819 2/1990 Ericsson et al. ..... 540/475

FOREIGN PATENT DOCUMENTS 1200183 9/1965 Fed. Rep. of Germany .

*Primary Examiner*—Stephen J. Lechert, Jr.

*Attorney, Agent, or Firm*—Pollock, Vande Sande & Priddy

[57] ABSTRACT

The disclosure relates to a method and a device for producing compositions comprising fine-grained crystalline explosive substances with the aid of a steam-driven ejector (22). The expression explosive substances is here taken to mean both low and high explosives.

12 Claims, 1 Drawing Sheet

METHOD FOR THE PRODUCTION OF FINE-GRAINED EXPLOSIVE SUBSTANCES

TECHNICAL FIELD

Figures 1, 1A:
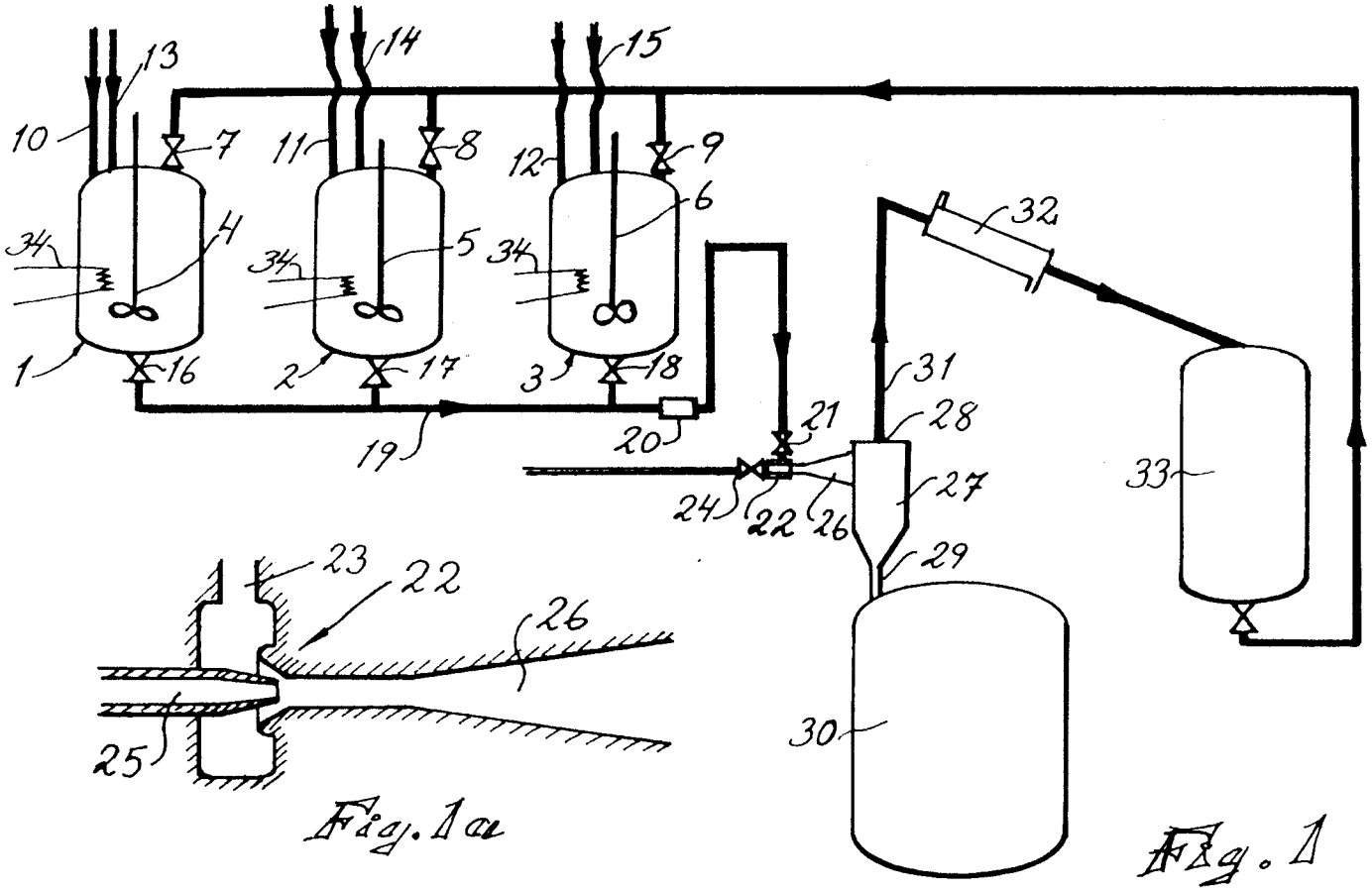

The present invention relates to a method and a device for producing compositions including fine-grained crystalline explosive substances. The overall term explosive substance as used in the present context embraces both low explosives and high explosives. Furthermore, in this context the term low explosive is taken to mean such explosive substances as are normally disintegrated by combustion and which are used for propulsion of rockets of one kind or another or for projectiles in guns, while the term high explosive relates to such explosive substances as are caused in their main use to disintegrate by detonation.

BACKGROUND ART

The demand for fine-grained explosives for the production of, for example, nitramine propellant and PBX has increased in recent years. In order to be able to meet this demand, new avenues of approach have been tested for producing fine-grained fractions of old, tried and proven crystalline high explosives such as hexogen or trimethylene trinitramine (RDX), octogen or cyclotetramethylene tetranitramine (HMX) and pentyl or pentaerytrol trinitrate (PETN) and others. In this disclosure, the expression fine-grained crystalline substances is taken to mean such as those having a mean particle diameter (MPD) of less than 20 μm.

The currently applied processes for producing fine-grained high explosives are either doubtful from the standpoint of safety or are impossible from considerations of economy. Numbered among the first group is the currently most widely used method which is based on grinding the high explosive in a mill in the presence of large amounts of liquid, a method which, with the passage of time, has suffered—despite the addition of liquid—from a large number of incidents and consequently can hardly be described as entirely without risk. A further component of this problem structure is that it is difficult to produce sufficient amounts of fine-grained high explosives simply by separating the most finely-grained fractions from each batch of crystalline high explosive. Moreover, the mixing stage itself is an integral part of the production of composite explosives, a stage which, in particular if it must be carried out in the dry state, involves an additional element of risk.

OBJECT OF THE PRESENT INVENTION

The object of the present invention is to obviate these problems and offer a safe and reliable method of producing desired amounts of fine-grained crystalline high explosives for use directly or together with a binder in PBX, or as a sub-component in a low explosive. Moreover, the present invention allows direct manufacture of a low explosive compound incorporating a fine-grained explosive.

As examples of components included in a low explosive mention may be made of ethylene cellulose (EC), cellulose acetate (CA), cellulose acetate butyrate (CAB), nitrocellulose (NC), nitroglycerine (Ngl), adipates, phthalates, stabilizers and combustion catalysts.

SUMMARY OF THE INVENTION

The present invention is based on rapid crystallization and precipitation of relevant crystalline and noncrystalline substances in a steam-driven ejector. Water vapour is suitably used to drive the ejector.

This method has several different advantages besides providing crystals of the desired size, i.e. with a mean particle size of less than 20 μm and a uniform distribution of any other substances as may be included in, for example, a low explosive. The device employed for carrying out the method according to the present invention—this device also being included in the invention as disclosed herein—completely lacks moving parts in the ejector used for precipitation of the substances included and the subsequent cyclone or separator, this providing a simple device in which every risk of overheating of bearings or boiling dry, with all the implicit mechanical risks of ignition, have been entirely eliminated. Moreover, the method and the device according to the present invention are easy to control and may be operated at high capacity. The method and the device according to the invention also enjoy the advantage that they offer direct purification of the solvent in conjunction with the precipitation stage, whereby the solvent will become immediately available for re-use, which obviously is economically advantageous.

According to the invention all relevant components, which may be both pure high explosives and mixtures of other components desired in the end product (which may thus also be a low explosive) and explosive, are dissolved in a suitably vaporizable solvent, such as acetone or methylethyl ketone (MEK), the solution being heated to just below the boiling point of the solvent. The solution is then subjected to positive pressure for two reasons, firstly to prevent it from beginning to boil in the pipes and secondly for reasons of transport engineering. To raise the pressure, use is made of a suitable inert gas such as nitrogen or carbon dioxide. The positive pressure need not be extreme, one or a few atmospheres being sufficient. The hot solution is then fed under positive pressure appropriately via a filter and a flowmeter to the inlet side of a steam-driven ejector. Both the steam flow and the solution flow to the ejector are appropriately regulated by means of controllable valves disposed immediately upstream of the ejector. The diffuser included in the ejector empties in turn into a cyclone.

When the solution is introduced by means of the steam into the diffuser of the ejector, the solvent is vaporized and the components dissolved therein are precipitated very rapidly in the aqueous phase in the form of fine-grained solid particles which are separated from the solvent fumes in the subsequent cyclone. In the cyclone, the precipitated solid components are collected for further processing, while the solvent fumes are conveyed to a condenser for cooling, condensation and collection for recycling and re-use.

The most manifest advantages inherent in the method and device according to the present invention may be summarized as follows:

1. No handling of dry high explosive. (This may be batched moistened with water or alcohol.)
2. No grinding.
3. Small crystals of the desired size.
4. The crystal size and distribution may be controlled.
5. Possibilities of maintaining small tolerances in the composition of such products as contain both low explosive compound mass and crystalline high explosive.
6. The product can be obtained in water.
7. The product can be obtained phlegmatized.

8. Possibilities for only one flow to subsequent processing in a continuous process.

This should be compared with a conventional continuous process in which all raw material flows must be controlled most carefully and in which both grinding and different mixing stages must be included, which creates problems in terms of safety, composition and process control.

The present invention, as defined in the appended claims, will now be described in greater detail with particular reference to the accompanying schematic drawings and the subsequent examples.

In the accompanying drawings:

FIG. 1 schematically illustrates a device for carrying out the method according to the present invention; and FIG. 1*a* is a schematic view of a detail design of the steam ejector.

The device shown schematically in the drawing for producing fine-grained explosive substances containing one or more different substances consists of three different dissolving vessels 1, 2 and 3, each fitted with an agitator 4, 5 and 6. In addition, each dissolving vessel is provided with a first adjustable inlet 7, 8 and 9 for the solvent and a second adjustable inlet 10, 11 and 12 for the solid component which is to be included in the final product and which thus may consist of one or more explosive substances and possibly also other substances. Finally, each dissolving vessel is fitted with a third inlet 13, 14 and 15 for an inert gas such as nitrogen, enabling the closed vessels provided with heating devices 34 may be placed under a certain positive pressure. The dissolving vessels 1, 2 and 3 communicate by means of bottom valves 16, 17 and 18, with a main supply pipe 19 which, in turn, includes a filter 20 and an adjustable flow valve 21. The latter runs out into an ejector 22 in the inlet 23 thereof, which is disposed at right angles to the feed direction of the ejector (see detail FIG. 1*a*), for material treated in the ejector. The ejector is further provided with an inlet 25 fitted with a control valve 24 for water vapour. Since the water vapour acts as a driving medium in the ejector, the inlet 25 is disposed in the feed direction of the ejector.

The diffuser included in the ejector is designated 26. This flows out into a cyclone 27 where the fine-grained product is separated from the solvent fumes which leave the cyclone via an upper outlet aperture 28 for the solvent fumes while the solid components leave the cyclone via a lower outlet aperture 29.

In the Figure, further processing of the thus obtained product is indicated by the vessel 30, while the solvent, which thus leaves the cyclone via the outlet aperture 28 then follows a pipe 31 to the cooler 32 where it is condensed and is then conveyed in condensed form to the collection vessel 33 whence it may be recycled as required via the pipe 35 to the dissolving vessel 1, 2 and 3, respectively.

The example described above includes three dissolving vessels, but there may be either only one or several vessels, depending on how the necessary output stock is best prepared from them.

In the examples referred to below, the device sketched in the drawing is employed, the requisite number of dissolving vessels being employed in each particular case.

EXAMPLE 1

PREPARATION OF FINE-CRYSTALLINE HIGH EXPLOSIVE

Method: 6 kg of hexogen were added to 60 l of methylethyl ketone and 20 l of water under agitation. The mixture was heated under agitation to 60°–70° C. until complete dissolution of the high explosive had been obtained.

The solution was pressurized with nitrogen gas (1 atm positive pressure) and was subsequently fed to the ejector at an adjusted flow rate of 4 l/min. At the same time, water vapour at a vapour pressure of 3 kg/cm$^2$ was supplied to the ejector.

Result: After crystallization in the ejector, separation from the solvent in the cyclone and dewatering, 5.9 kg of hexogen with a mean particle size of 8 μm was obtained. 90% of the solvent could be recovered in the condenser.

EXAMPLE 2

PREPARATION OF FINE-GRAINED LOW EXPLOSIVE CONTAINING FINE-GRAINED CRYSTALLINE HIGH EXPLOSIVE

Method: 7.06 kg of moist hexogen (15% moisture), 0.95 kg of cellulose acetate butyrate (CAB), 0.600 kg of tributyl citrate (TBC), 0.315 kg of nitrocellulose (NC) and 0.032 kg of centralite were added to 60 kg of water-saturated (approx. 12%) methylethyl ketone. The mixture was heated to approx. 70° C. under agitation and the dissolving vessel was pressurized with nitrogen gas (1 atm), the mixture being fed to the ejector at a flow rate of 3 kg/min and at a vapour pressure of approx. 3 kg/cm$^2$. The precipitated product was washed with water and dried.

Result: After drying, 7.6 kg of low explosive compound were obtained. Approx. 80% of the solvent could be recovered.

What we claim and desire to secure by letters patent is:

1. A method of producing compositions from fine-grained crystalline explosive substances, characterized in that the relevant starting components are dissolved in a vaporizable solvent capable of dissolving said components, whereafter the thus obtained solution is supplied to a steam-driven ejector with associated diffuser whose design and volumes of solvent and steam respectively supplied to the ejector are adapted so that the solvent is vaporized in the diffuser of the ejector and the crystalline components dissolved in the solvent are crystallized out and any other components dissolved in said solvent are precipitated.

2. The method as claimed in claim 1, characterized in that one or more high explosives is/are added as crystalline explosive in the dissolution stage.

3. The method as claimed in claim 1, characterized in that as starting components one or more crystalline products are added which are generally designated high explosives, as well as one or more components generally designated low explosive raw materials.

4. The method as claimed in claim 1, characterized in that the solution of the starting components is heated to a temperature above room temperature but below the boiling point of the solvent before the solution is supplied to the ejector.

5. The method as claimed in claim 4, characterized in that while being heated the solution is placed under positive pressure by an inert gas in order thereby to prevent the solvent form beginning to boil off on its way towards the ejector.

6. The method as claimed in claim 1 characterized in that the precipitation of the crystalline components is controlled so that these will have a mean diameter of $=<20\ \mu m$.

7. The method as claimed in claim 1 characterized in that methylethyl ketone or alternatively acetone is used as solvent.

8. The method as claimed in claim 1 characterized in that water is added together with the solvent.

9. The method of claim 1 which further comprises conveying the materials that are crystallized out and precipitated to a cyclone subsequent to the diffuser at the ejector to separate said materials from the solvent.

10. The method of claim 9 wherein solvent from said cyclone is condensed outside said cyclone.

11. The method of claim 10 wherein said solvent after being condensed is reused.

12. The method of claim 5 wherein said inert gas is nitrogen or carbon dioxide.

* * * * *

UNITED STATES PATENT AND TRADEMARK OFFICE

CERTIFICATE OF CORRECTION

PATENT NO. : 4,983,235

DATED : January 8, 1991

INVENTOR(S) : Jan-Olof Nyqvist, et al.

It is certified that error appears in the above-identified patent and that said Letters Patent is hereby corrected as shown below:

Column 3, line 42, after the term "water vapour" insert --- (i.e. - steam) ---.

Column 3, line 48, after the term "fumes" insert --- or vapor ---.

Column 3, line 50, replace the term "fumes" with --- vapor ---.

Column 4, line 13, replace the term "water vapour" with --- steam ---.

Column 4, line 37, replace the term "low explosive" with --- propellant ---.

Column 4, line 61, replace the term "low explosive" with --- propellant ---.

Signed and Sealed this

Tenth Day of November, 1992

*Attest:*

DOUGLAS B. COMER

*Attesting Officer*

*Acting Commissioner of Patents and Trademarks*